US005564231A

United States Patent [19]

Tajima et al.

[11] Patent Number: 5,564,231

[45] Date of Patent: Oct. 15, 1996

[54] POWER WINDOW DRIVE DEVICE OF REDUCED SIZE

[75] Inventors: Keiichi Tajima; Takeshi Toyoshima, both of Shizuoka, Japan

[73] Assignee: Koito Manufacturing Co., Ltd., Tokyo, Japan

[21] Appl. No.: 366,901

[22] Filed: Dec. 30, 1994

[30] Foreign Application Priority Data

Dec. 30, 1993 [JP] Japan ..... 5-354556

[51] Int. Cl.[6] ..... E05F 11/48

[52] U.S. Cl. ..... 49/352; 74/89.22; 403/359

[58] Field of Search ..... 49/352, 227; 74/89.22; 403/359

[56] References Cited

U.S. PATENT DOCUMENTS

| | | | |
|---|---|---|---|
| 4,534,233 | 8/1985 | Hamaguchi | 49/352 X |
| 4,813,808 | 3/1989 | Gehrke | 403/359 X |
| 4,859,110 | 8/1989 | Dommel | 403/359 X |
| 5,207,393 | 5/1993 | Marscholl | 49/352 X |

FOREIGN PATENT DOCUMENTS

| | | | |
|---|---|---|---|
| 2553667 | 1/1979 | Germany | E05F 15/16 |
| 3519056 | 7/1987 | Germany | E05F 15/16 |
| 2952408 | 11/1988 | Germany | H02K 7/116 |
| 3905589 | 8/1990 | Germany | E05F 15/16 |

*Primary Examiner*—Philip C. Kannan

*Attorney, Agent, or Firm*—Sughrue, Mion, Zinn, Macpeak & Seas

[57] ABSTRACT

A power window drive device, including a motor, a worm wheel, a drive drum, and the like, whose manufacturing cost is reduced and which has a reduced size. A rotary shaft, driven by a motor, has a flange extending outward and a spline extending from the flange to the end of the rotary shaft. A drive drum, axially coupled to the rotary shaft, has a shaft hole with a spline and resiliently deformable hook pieces. The hook pieces engage the flange of the rotary shaft, thereby making the rotary shaft immovable in the axial direction. By inserting the end of the rotary shaft into the shaft hole of the drive drum, thereby coupling the splines and making the hook pieces engage the flange of the rotary shaft, the rotary shaft is made immovable with respect to the drive drum in both the axial and the circumferential directions. With this construction, there is no need of separate coupling elements, and the work to assemble the device is simplified.

8 Claims, 5 Drawing Sheets

POWER WINDOW DRIVE DEVICE OF REDUCED SIZE

BACKGROUND OF THE INVENTION

The present invention relates to a power window drive device for opening and closing a window of a motor vehicle with the use of a drive source such as a motor. More particularly, the invention relates to a power window drive device for driving a wire used for opening and closing the window.

FIG. 5 is a side view showing the overall construction of a power window drive device of a type with which the present invention can be used. A window opening/closing mechanism 1 is mounted inside the door of a vehicle in the area under a window. The window opening/closing mechanism 1 is provided with a rail 2 along which a slider 3 is slidable. A wire 4, coupled to the slider 3, is wound around pulleys 5 provided at the top and the bottom of the rail 2, as well as a drive drum 10 located at a mid portion of the rail. The window drive section 6 includes a motor 9 for driving the drive drum. When the motor 9 is driven, the wire 4 is moved by the drive pulley 10 so that the slider 3 vertically moves. A window glass 7 is attached to the slider 3. When the window glass 7 is vertically moved together with the slider 3, it opens and closes a window space defined by a sash. In FIG. 5, a position sensor 8 is driven by an arm 3*a* of the slider 3 to detect the position of a window glass 7.

In the window drive section 6, when the motor 9 is driven, a worm gear is turned to rotate a worm wheel. Accordingly, the drive drum 10, provided coaxially with the rotary shaft of the worm wheel, is turned through the rotary shaft thereof.

The coupling structure of the rotary shaft with the drive drum is illustrated in FIG. 6. In FIG. 6, the rotary shaft and drive drum are respectively designated by reference numerals 28A and 10A. As shown, an oblong part 42 of the rotary shaft 28A is inserted into a shaft hole 43 of the drive drum 10A that is also oblong in shape. A flange 44, extending outward from the outer surface of the rotary shaft 28A, abuts a part of the outer surface of the drive drum 10A. In this way, the shaft is positioned. The bottom end of the rotary shaft 28A passes through the drive drum 10A. A metal washer 45 is fitted on the tip of a part of the rotary shaft 28A that protrudes from the drive drum 10A. Further, a stopper member 46, such as a C ring, is fitted in a circumferential groove formed in the outer surface of the rotary shaft and located outside the stopper member 46 (when viewed in the axial direction of the rotary shaft). With this arrangement, the rotary shaft 28A is prevented from slipping out of the structure.

In the coupling structure thus constructed, the circumferential groove receiving the C ring 46 must be formed in the outer surface of the rotary shaft. As a result, the cost to work the rotary shaft for forming the groove is high.

In the coupling structure for coupling the rotary shaft 28A to the drive drum 10A, the drive drum 10A is made of synthetic resin. If the C ring 46 is brought into direct contact with the drive drum 10A, the drive drum 10A tends to be worn by the C ring 46. To avoid wear of the drive drum 10A, the metal washer 45 is inserted between the drive drum 10A and the C ring 46. In this respect, the number of required parts is increased and the cost of manufacture is also increased. For the same purpose, in the rotary shaft of the power window drive device, an additional C ring (not shown) is provided in the portion of the rotary shaft where it is coupled to the worm wheel. Thus, two C rings must be mounted in assembling the power window drive device, making the assembly work inefficient.

To couple the drive drum 10A to the rotary shaft 28A, the oblong part 42 of the rotary shaft 28A (of the worm wheel) is inserted into the shaft hole 43, also oblong in shape, of the drive drum 10A. With this coupling structure, the rotational force generated therebetween is concentrated on the planar portions of the oblong shaft hole. In an extreme case, the shaft hole 43 of the drive drum 10A made of synthetic resin can be damaged, making the rotational coupling of these members poor.

Since the bottom end of the rotary shaft protrudes from the drive drum, the size of the structure as viewed in the axial direction is increased. This results in increase of the thickness of the body case 11A forming the window drive section 6.

SUMMARY OF THE INVENTION

Accordingly, an object of the present invention is to provide a power window drive device which reduces manufacturing costs and realizes size reduction.

In accordance with the above and other objects, the invention provides a power window drive device in which a rotary shaft driven by a drive source, such as a motor, has an outwardly extending flange, and a spline extends from the flange to the end of the rotary shaft. A drive drum, axially coupled with the rotary shaft, has a shaft hole with a spline that corresponds to the spline of the rotary shaft, and resiliently deformable hook pieces. When the end of the rotary shaft is inserted into the shaft hole, the hook pieces engage the flange of the rotary shaft, thereby making the rotary shaft immovable in the axial direction.

DESCRIPTION OF THE PREFERRED EMBODIMENTS

By inserting the spline of the end of the rotary shaft into the spline of the drive drum, the rotary shaft is coupled with the drive drum in a state such that the former is immovable with respect to the latter in the rotational direction. By making the flange of the rotary shaft engage the hook pieces, the rotary shaft is coupled to the drive drum in a state in which the former is immovable with respect to the latter in the axial direction. Therefore, there is no need to provide other parts to couple these members, and the work required for coupling the members during manufacture is simplified.

Figure 5:
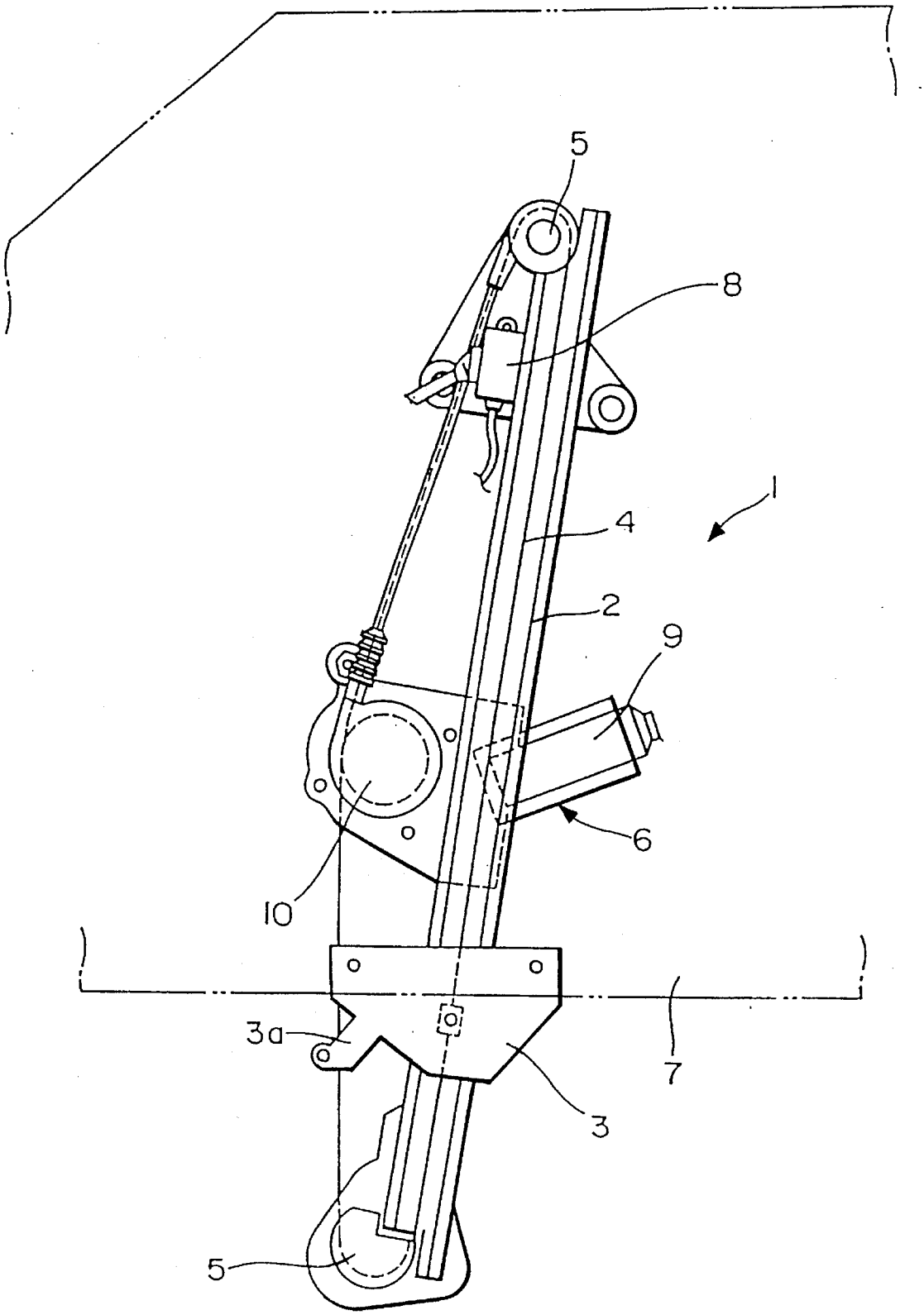
FIG. 5 is a diagram showing an example of a power window device to which the present invention is applied.

A preferred embodiment of the present invention will be described with reference to the accompanying drawings. In this embodiment, the invention is applied to a power window drive device of the type described with reference to FIG. 5.

Figure 1:
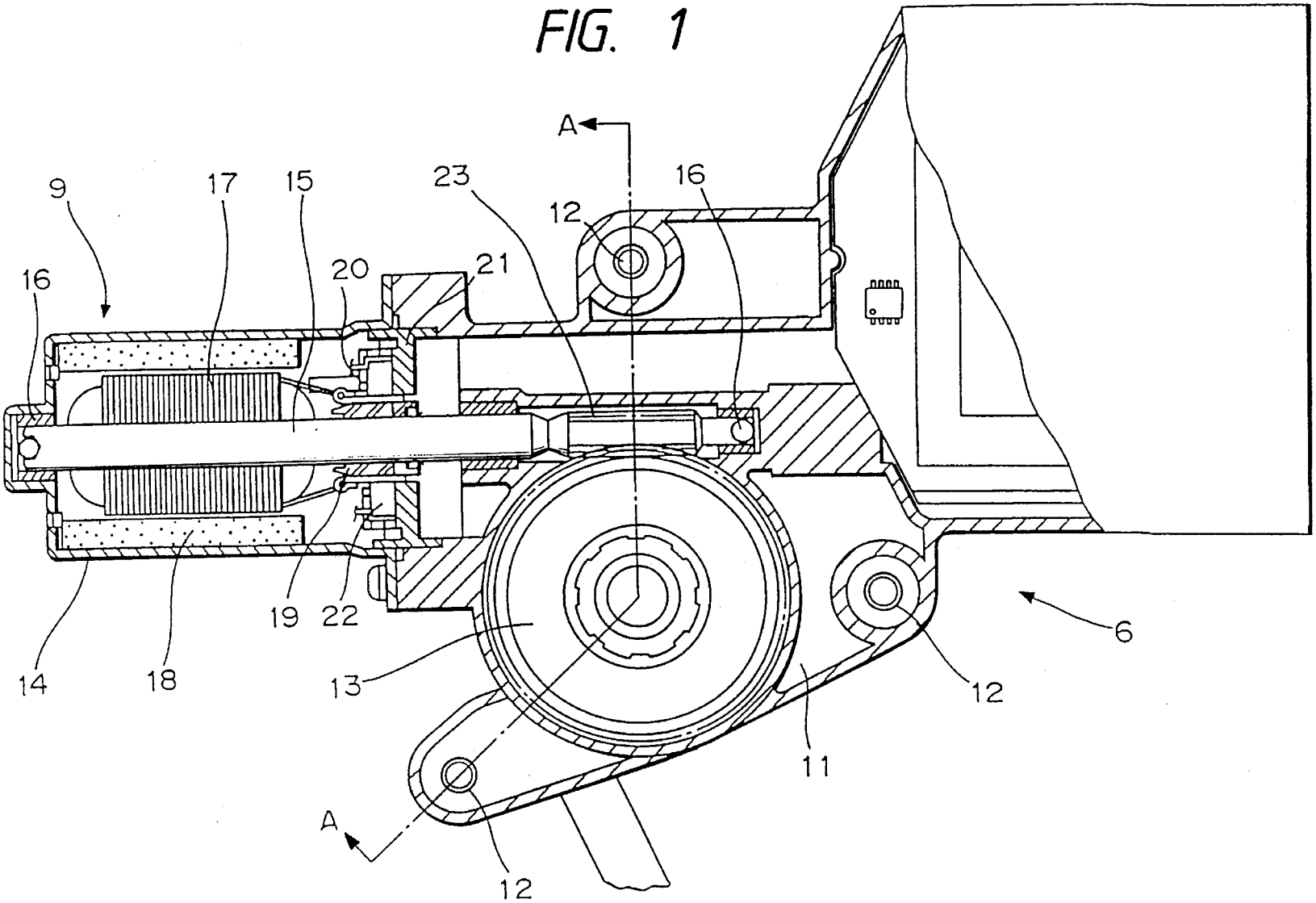
FIG. 1 is a horizontal sectional view showing a key portion of a power window drive device according to a preferred embodiment of the present invention.

The window drive section, as shown in the cross-sectional view of FIG. 1, includes a body case 11 made of synthetic resin. A plural number of screws 12 are screwed into the body case 11. A worm wheel 13 is provided within the body case 11. The motor 9 is mounted in an opening of the side wall of the body case 11. Within a tubular motor case 14 containing the motor 9, a rotary shaft 15 extends along the longitudinal axis of the motor case 14 in a state such that the rotary shaft 15 is supported at both ends by bearings 16.

A rotor 17 including an iron core and a coil is mounted on the rotary shaft 15. A stator 18 is mounted on the inner surface of the motor case 14, disposed around the rotor 17. A commutator 20 is provided on a cylindrical collar 19 made of insulating material mounted on the rotary shaft 15. A conductive brush 22 contacts the commutator 20. The conductive brush 22 is disposed on a lock ring 21 supported between the body case 11 and the motor case 14. A worm gear 23 is firmly attached to the second end of the rotary shaft 15. The worm gear 23 is in mesh with the large-diameter worm wheel 13, and is supported by a shaft within the body case 11.

Figure 2:
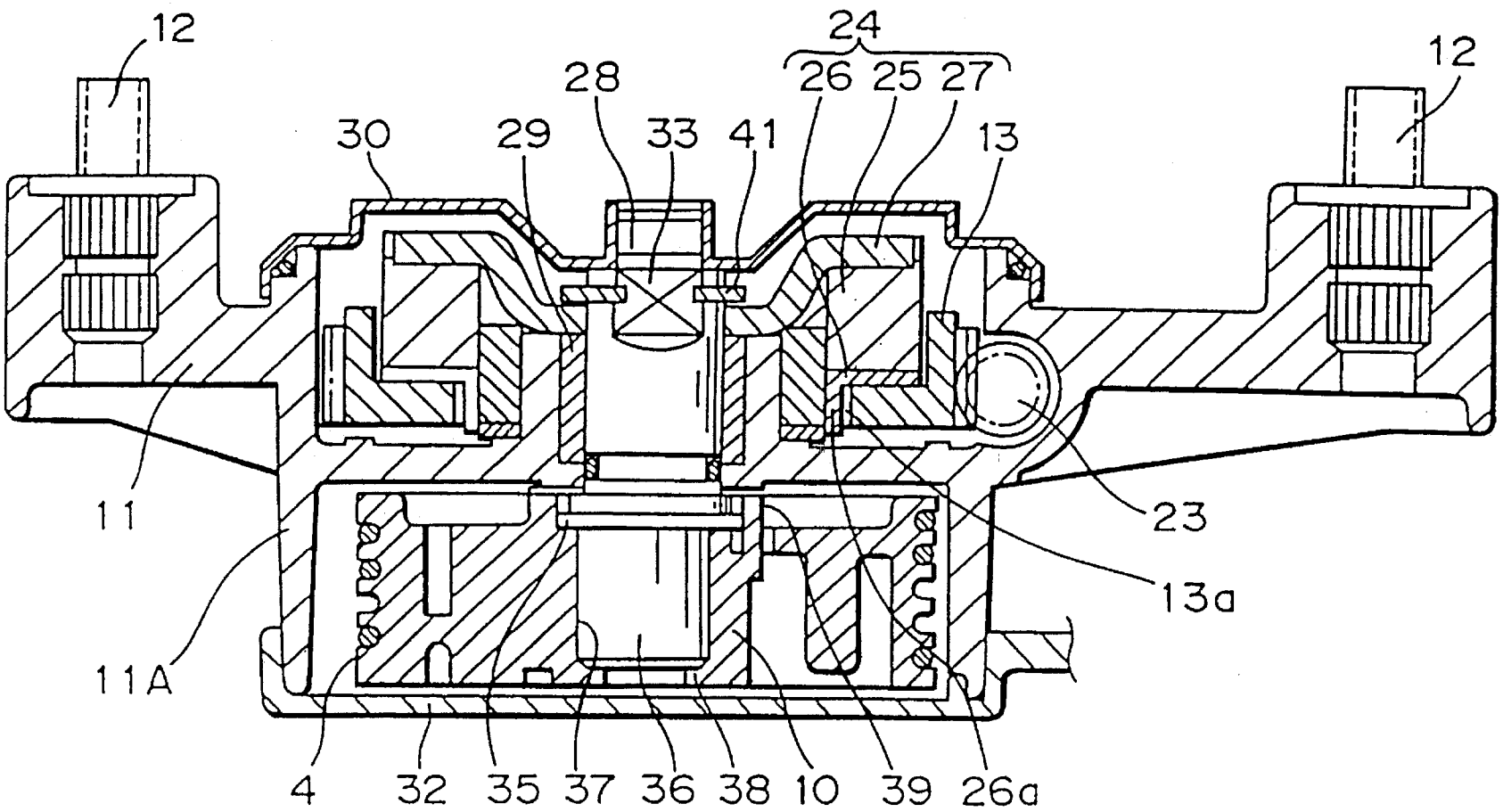
FIG. 2 is a cross-sectional view taken on a line A—A in FIG. 1.
Figure 3:
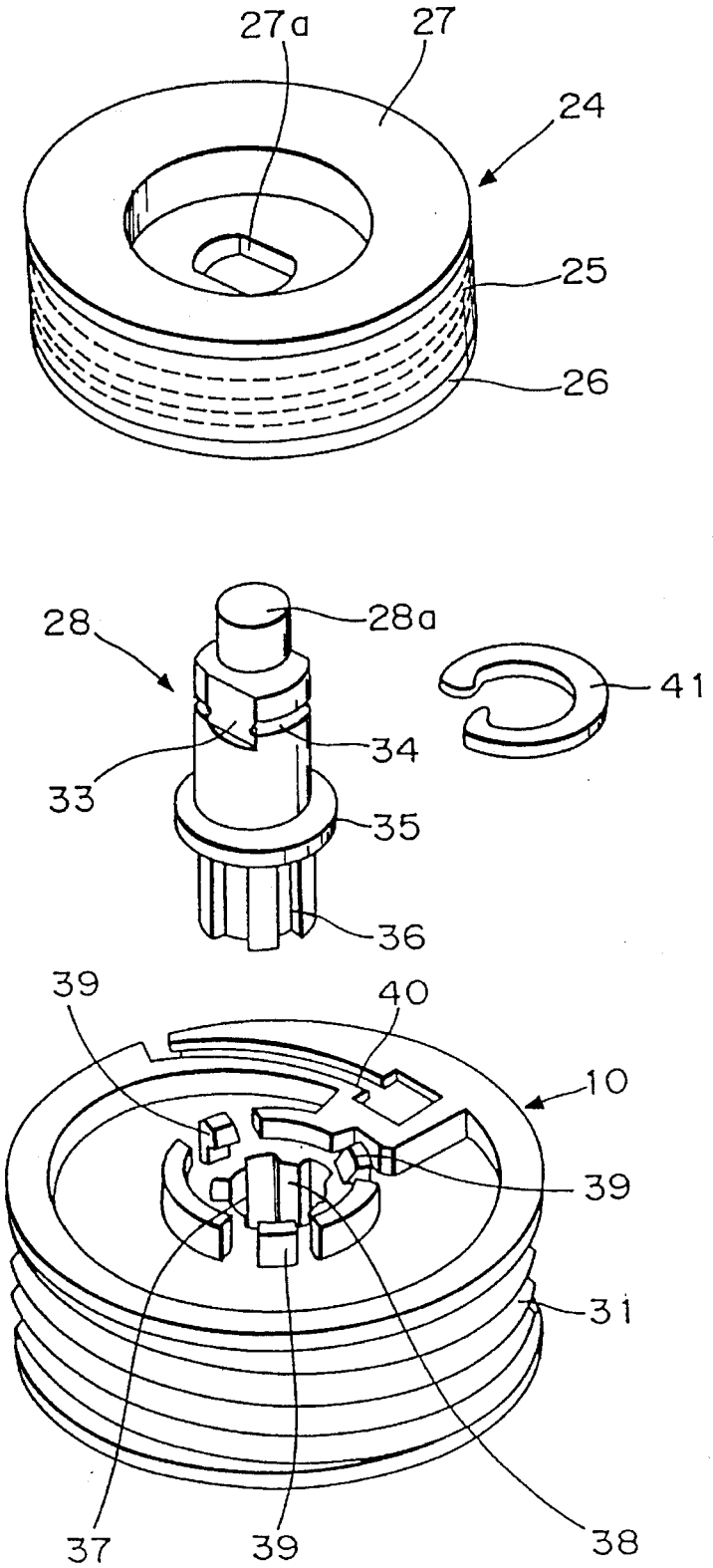
FIG. 3 is an exploded view showing a key portion of the power window drive device.
Figure 4:
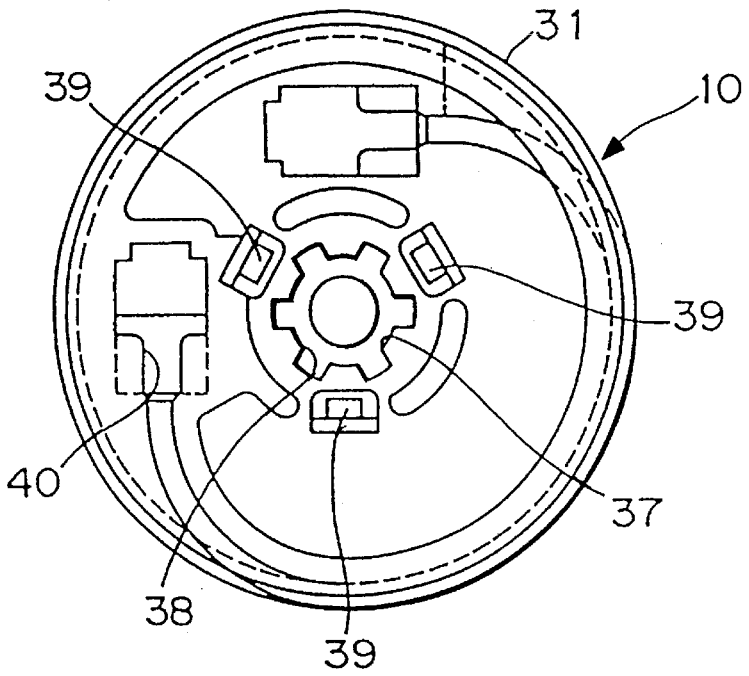
FIG. 4 is a plan view showing a drive drum.
Figure 6:
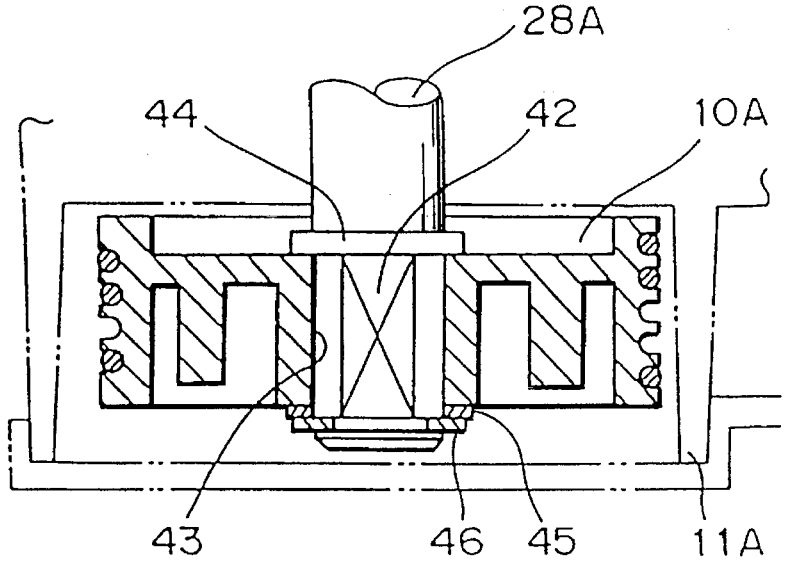
FIG. 6 PRIOR ART
FIG. 6 is a cross-sectional view showing a conventional coupling structure of a drive drum and a rotary shaft of a worm wheel.

FIG. 2 is a cross-sectional view taken on a line A—A in FIG. 1. FIG. 3 is an exploded view showing a key portion of the power window drive device. FIG. 4 is a plan view showing a drive drum. The worm wheel 13 is located within the body case 11. The worm wheel 13 has a ring-like concavity formed along the circumference thereof. A ring-like damper 24 is located in the ring-like concavity. The ring-like damper 24 includes mainly a ring-like resilient member 25 whose diameter is slightly smaller than the dimensions of the ring-like concavity. A ring-like inner damper bracket 26 formed of a thin metal plate is bonded to one side of the ring-like damper 24. A plural number of engaging pieces **26*a* axially protrude from the inner damper bracket 26. When the engaging pieces 26*a* are inserted into engaging holes 13*a* formed in one side of the worm wheel 13, the components are coupled in the rotational direction. An outer damper bracket 27 formed of a thick metal plate, shaped like a disc, is bonded to the other side of the ring-like damper 24. An oblong shaft hole 27*a* is formed in the central part of the outer damper bracket 27. A rotary shaft 28 made of metal is fastened within the oblong shaft hole 27*a* of the outer damper bracket. The rotary shaft 28 is supported by a tubular bearing 29 made of oil-contained metal. The bearing 29 is provided within a through-hole of the body case 11. A reduced-diameter part 28*a* extending from one end of the rotary shaft 28 is axially supported by a cap 30 attached to the body case 11**.

The body case 11 includes a tubular case 11A defining a space opposed to the space of the body case 11 in which the worm wheel 13 is located. The drive drum 10, shaped like a thick disc, is coaxially placed in the tubular case 11A. Within the tubular case 11A, the drive drum 10 is firmly coupled to the other end of the rotary shaft 28 that passes through the body case 11. A spiral groove 31 is formed on the outer surface of the drive drum 10. The wire 4 used to open and close the window is received in the spiral groove 31. The opening of the tubular case 11A is covered with a removable cover 32.

The rotary shaft 28 includes a portion 33 located close to one end thereof. The portion 33 is oblong in shape in conformity with the oblong shaft hole 27a of the outer damper bracket 27. A groove 34 is formed in the outer surface of the oblong portion 33. A circular flange 35 extends outward from the mid portion of the oblong portion 33. An axially extending spline 36 is formed on the outer surface of a portion of the oblong portion 33 located closer to the other end of the rotary shaft 28 than the circular flange 35.

A shaft hole 37 as a blind hole is formed in the central portion of the drive drum 10. A spline 38 is formed in the inner surface of the shaft hole 37 in association with the spline 36 of the rotary shaft 28. Hook pieces 39 protrude from three locations uniformly spaced around the opening of the shaft hole 37 in a state such that the hooking parts of the hook pieces 39 are directed inward. The hook pieces 39 made of synthetic resin are integral with the drive drum 10. The diameter of an imaginary circle connecting these hook pieces 39 is substantially equal to the outer diameter of the circular flange 35. A groove 40 in the drive drum 10 receives one end of the wire 4, and the wire is fixed thereto.

To assemble the rotary shaft 28, the drive drum 10, and the ring-like damper 24, first, the rotary shaft 28 is axially inserted into the shaft hole 37 of the drive drum 10 with the wire 4 that is received in the groove of the outer surface of the drum. In this case, the insertion operation is performed while inserting the spline 36 of the second end portion of the rotary shaft 28 into the spline 38 of the shaft hole 37. During the course of the insertion, the circular flange 35 of the rotary shaft 28 abuts the hook pieces 39. At this time, the rotary shaft 28 is forcibly pushed into the shaft hole 37. Then, the hook pieces 39 are resiliently deformed to allow the rotary shaft 28 to further advance. In other words, the circular flange 35 of the rotary shaft 28 forcibly opens the hook pieces 39. The hook pieces 39 are then restored to their original positions and engage the circumferential edge of the circular flange 35. In this state, the rotary shaft 28 is prevented from slipping off the drive drum 10. As a consequence, the drive drum 10 is immovable with respect to the rotary shaft 28 in both axial and rotational directions.

Then, the drive drum 10 is set in the tubular case 11A in a state such that the first end of the rotary shaft 28 passes through the body case 11 and is supported by the bearing 29. Further, the cover 32 is applied to the tubular case to cover the body case 11A.

The worm wheel 13 with the ring-like damper 24 contained therein is set in the body case 11. At this time, the oblong portion 33 of the rotary shaft 28 upward standing within the body case 11 receives the oblong shaft hole **27*a* of the outer damper bracket 27 of the ring-like damper 24. In this state, the outer damper bracket 27 is immovable with respect to the rotary shaft 28 in the rotational direction. A C ring 41 is fitted to the circumferential groove 34 of the outer surface of the oblong portion, so that the two components are locked in the axial direction. Thereafter, the cap 30 made of metal is applied to the assembly and fastened thereto. In this state, the reduced-diameter part 28*a* of the rotary shaft 28 is received by the cap 30**.

In the coupling structure of the drive drum 10 and the rotary shaft 28 of the worm wheel, to assemble the rotary shaft 28 to the drive drum 10, it is only necessary to insert the rotary shaft 28 into the drive drum 10. In this case, there is no need of providing a washer and ring. This feature reduces the number of parts required, simplifies the assembly work, and hence reduces manufacturing costs.

In the assembly of the rotary shaft 28 and the drive drum 10, the shaft and the drum are coupled to one another by the splines. The rotational stress generated between the rotary shaft 28 and the drive drum 10 is dispersed by the plural number of ridges of the splines. Therefore, the present invention successfully eliminates the problem of the conventional power window drive device wherein rotational force is concentrated on the shaft hole 37 of the synthetic resin drive drum 10, thereby leading to damage.

Additionally, the second end of the rotary shaft 28 does not pass through or protrude therefrom. This feature reduces the height of the power window drive device, and realizes size reduction and thinning of the power window drive device.

For maintenance, to remove the rotary shaft 28 from the drive drum 10, the hook pieces 39 are resiliently deformed outward in a forcible manner, thereby to disengage from the circular flange 35.

In a power window drive device according to the present invention, a rotary shaft has a flange extending outward and a spline extending from the flange to the end of the rotary shaft. A drive drum, axially coupled to the rotary shaft, has a shaft hole with spline grooves and resiliently deformable hook pieces. The hook pieces engage the flange of the rotary shaft, thereby making the rotary shaft immovable in the axial direction. When the end of the rotary shaft is inserted into the shaft hole, the hook pieces engage the flange of the rotary shaft, so that the rotary shaft is rendered immovable with respect to the drive drum in both axial and circumferential directions. With this construction, there is no need to provide additional coupling parts, and hence the manufacturing cost is reduced. Further, the rotary shaft may be coupled to the drive drum in a single manual operation. As a result, the coupling work is simplified. Further, the rotary shaft does not protrude from the drive drum. This structural feature enables the power window drive device to be made thin.

What is claimed is:

1. A power window drive device comprising: a drive source, a rotary shaft driven by said drive source, a drive drum axially coupled to said rotary shaft, a wire coupled at one end to a window glass and at another end to said drive drum, said drive drum being operative for driving said wire to move said window glass between open and closed positions, said rotary shaft having a flange extending outward and a spline extending from said flange to an end of said rotary shaft, said drive drum having a shaft hole with a spline engaged with said spline of said rotary shaft and said shaft hole further having therearound a plurality of resiliently deformable hook pieces, wherein when said end of the rotary shaft is inserted into said shaft hole, said hook pieces engage said flange of said rotary shaft, thereby making said rotary shaft immovable in an axial direction thereof.

2. The power window drive device of claim 1, further comprising a worm gear fixed to a drive shaft of said drive source, and a worm wheel meshed with said worm gear, said worm wheel being coupled to said rotary shaft to rotate said rotary shaft.

3. The power window drive device of claim 2, wherein said worm gear comprises a ring-like damper provided in a ring-like concavity formed along a circumference of said worm wheel.

4. The power window drive device of claim 3, wherein said worm gear further comprises a disc-shaped damper bracket bonded on one side of said damper, an oblong shaft hole being formed in a central part of said damper bracket, said rotary shaft having an oblong portion received in said oblong shaft hole.

5. The power window drive device of claim 4, wherein a circumferential groove is formed in an end portion of said rotary shaft outside said damper bracket, and further comprising a C ring fitted into said circumferential groove.

6. The power window drive device of claim 5, further comprising a body case and a cap closing said body case, said body case and cap enclosing said rotary shaft, said drive drum, said worm gear, said worm wheel, and said damper bracket.

7. The power window drive device of claim 6, wherein said cap has a hole therein receiving an end portion of said rotary shaft.

8. The power window drive device of claim 1, wherein said hook pieces have hooking parts extending inward toward said rotary shaft, a diameter of a circle connecting said hook pieces being substantially equal to an outer diameter of said flange.

* * * * *